US006241500B1

(12) United States Patent
Ellis

(10) Patent No.: US 6,241,500 B1
(45) Date of Patent: Jun. 5, 2001

(54) DOUBLE-THROW AIR MOTOR WITH REVERSE FEATURE

(75) Inventor: Fife Baker Ellis, Houston, TX (US)

(73) Assignee: Cooper Brands, Inc., Houston, TX (US)

( * ) Notice: Subject to any disclaimer, the term of this patent is extended or adjusted under 35 U.S.C. 154(b) by 0 days.

(21) Appl. No.: 09/533,753

(22) Filed: Mar. 23, 2000

(51) Int. Cl.[7] ..... F01C 21/00

(52) U.S. Cl. ..... 418/270; 418/1

(58) Field of Search ..... 418/270, 1

(56) References Cited

U.S. PATENT DOCUMENTS

| | | | | |
|---|---|---|---|---|
| Re. 33,711 | | 10/1991 | Ono et al. . | |
| 1,931,167 | | 10/1933 | Price et al. . | |
| 2,159,232 | | 5/1939 | Shaff . | |
| 2,233,163 | * | 2/1941 | Fosnot | 418/89 |
| 2,257,893 | | 10/1941 | Van Sittert et al. . | |
| 2,339,530 | | 1/1944 | Van Sittert et al. . | |
| 2,401,190 | | 5/1946 | Reynolds . | |
| 2,575,524 | | 11/1951 | Mitchell . | |
| 2,580,631 | | 1/1952 | Whitledge . | |
| 2,733,687 | | 2/1956 | Schmid . | |
| 3,088,445 | | 5/1963 | Gardner . | |
| 3,093,360 | | 6/1963 | Krouse . | |
| 3,232,173 | | 2/1966 | Van Sittert et al. . | |
| 3,238,848 | | 3/1966 | Bent . | |
| 3,429,230 | | 2/1969 | Quackenbush . | |
| 3,439,422 | | 4/1969 | Doeden et al. . | |
| 3,453,936 | | 7/1969 | Biek et al. . | |
| 3,463,052 | | 8/1969 | Matson . | |
| 3,556,230 | | 1/1971 | Roggenburk . | |
| 3,574,915 | * | 4/1971 | Jeal | 29/200 |
| 3,596,718 | | 8/1971 | Fish et al. . | |
| 3,608,649 | | 9/1971 | Roggenburk . | |
| 3,614,275 | | 10/1971 | Eibsen . | |
| 3,640,351 | | 2/1972 | Coyne et al. . | |
| 3,700,363 | | 10/1972 | Sorenson et al. . | |
| 3,739,659 | | 6/1973 | Workman, Jr. . | |
| 3,760,887 | | 9/1973 | Palauro . | |
| 3,791,149 | | 2/1974 | Strecker et al. . | |
| 3,791,459 | | 2/1974 | Workman, Jr. . | |
| 3,827,834 | | 8/1974 | Kakimoto . | |
| 3,833,068 | | 9/1974 | Hall . | |
| 3,842,507 | | 10/1974 | Boucher . | |
| 3,862,813 | | 1/1975 | Strecker et al. . | |
| 3,865,520 | | 2/1975 | Kramer et al. . | |
| 3,904,305 | | 9/1975 | Boyd . | |
| 3,908,768 | | 9/1975 | Hess . | |
| 3,945,098 | | 3/1976 | Yascheritsyn et al. . | |
| 3,951,217 | | 4/1976 | Wallace et al. . | |
| 3,960,035 | | 6/1976 | Workman, Jr. et al. . | |
| 3,970,151 | | 7/1976 | Workman, Jr. . | |

(List continued on next page.)

FOREIGN PATENT DOCUMENTS

| | | | | |
|---|---|---|---|---|
| 3404918A1 | * | 8/1985 | (DE) | 418/270 |
| 577148A2 | * | 1/1994 | (EP) | 418/270 |
| 30378 | | 11/1959 | (FI) . | |

(List continued on next page.)

*Primary Examiner*—Thomas Denion
*Assistant Examiner*—Theresa Trieu
(74) *Attorney, Agent, or Firm*—Coats & Bennett, PLLC

(57) ABSTRACT

A reversible double-throw air motor utilizes a moveable cylinder casing to switch between forward and reverse operation. The cylinder casing rotates between its forward and reverse positions in response to movement of an externally accessible actuator, via a front bearing plate rotationally coupled to the cylinder casing. The actuator may be biased to the proper position by reaction forces generated within the motor. In some embodiments, the coupling of the front bearing plate to the cylinder casing allows for the cylinder casing to float, thereby enabling the cylinder casing to self-center about the rotor. In other optional embodiments, the front bearing plate is pressed against the cylinder casing during operation by air pressure. The resulting double-throw air motor is easy to use motor and may be economically produced.

21 Claims, 11 Drawing Sheets

U.S. PATENT DOCUMENTS

| | | | | |
|---|---|---|---|---|
| 3,989,113 | | 11/1976 | Spring, Sr. et al. . | |
| 3,998,130 | | 12/1976 | Hirmann . | |
| 4,004,859 | | 1/1977 | Borries . | |
| 4,010,819 | | 3/1977 | Ekstrom et al. . | |
| 4,023,627 | | 5/1977 | Clapp et al. . | |
| 4,062,411 | | 12/1977 | Adkins et al. . | |
| 4,078,618 | | 3/1978 | DePagter et al. . | |
| 4,109,735 | | 8/1978 | Bent . | |
| 4,175,408 | | 11/1979 | Kasai et al. . | |
| 4,177,024 | | 12/1979 | Lohn . | |
| 4,243,109 | | 1/1981 | Anderson . | |
| 4,243,110 | | 1/1981 | Clemenson et al. . | |
| 4,299,097 | | 11/1981 | Shank et al. . | |
| 4,320,806 | | 3/1982 | Koltermann et al. . | |
| 4,344,746 | | 8/1982 | Leonard . | |
| 4,346,765 | | 8/1982 | Workman, Jr. . | |
| 4,364,286 | * | 12/1982 | Ciolli | 74/768 |
| 4,374,632 | | 2/1983 | Wilcox . | |
| 4,380,270 | * | 4/1983 | Ludwig | 418/268 |
| 4,467,877 | | 8/1984 | Koltermann et al. . | |
| 4,533,337 | | 8/1985 | Schoeps . | |
| 4,669,961 | * | 6/1987 | Lorett | 418/1 |
| 4,683,961 | | 8/1987 | Schoeps . | |
| 4,708,210 | | 11/1987 | Rahm . | |
| 4,718,500 | | 1/1988 | Mori . | |
| 4,735,595 | | 4/1988 | Schoeps . | |
| 4,772,186 | | 9/1988 | Pyles et al. . | |
| 4,822,264 | * | 4/1989 | Kettner | 418/270 |
| 4,838,133 | | 6/1989 | Dainin . | |
| 4,844,177 | | 7/1989 | Robinson et al. . | |
| 4,919,022 | | 4/1990 | Ono et al. . | |
| 5,022,469 | | 6/1991 | Westerberg . | |
| 5,083,619 | | 1/1992 | Giardino et al. . | |
| 5,092,410 | | 3/1992 | Wallace et al. . | |
| 5,094,303 | | 3/1992 | Jenne . | |
| 5,163,519 | | 11/1992 | Mead et al. . | |
| 5,172,771 | | 12/1992 | Wilson . | |
| 5,217,079 | | 6/1993 | Kettner et al. . | |
| 5,327,636 | | 7/1994 | Wilson . | |
| 5,377,769 | | 1/1995 | Hasuo et al. . | |
| 5,383,771 | * | 1/1995 | Ghode et al. | 418/15 |
| 5,406,752 | * | 4/1995 | Neff | 418/270 |
| 5,525,097 | * | 6/1996 | Kakimoto | 418/270 |
| 5,544,710 | | 8/1996 | Groshans et al. . | |
| 5,548,889 | * | 8/1996 | Smith et al. | 29/715 |
| 5,611,404 | | 3/1997 | Biek et al. . | |
| 5,626,198 | | 5/1997 | Peterson . | |
| 6,082,986 | * | 7/2000 | Seward et al. | 418/270 |

FOREIGN PATENT DOCUMENTS

| | | | | |
|---|---|---|---|---|
| 1115165A1 | * | 5/1968 | (GB) | 418/270 |
| 2034407A1 | * | 6/1980 | (GB) | 418/270 |
| 2175231A1 | * | 11/1986 | (GB) | 418/270 |
| 57-044703A1 | * | 3/1982 | (JP) | 418/270 |
| 10-015505A1 | * | 1/1998 | (JP) | 418/270 |
| 11-090847A1 | * | 4/1999 | (JP) | 418/270 |
| 1420189A1 | * | 8/1988 | (SU) | 418/270 |

* cited by examiner

DOUBLE-THROW AIR MOTOR WITH REVERSE FEATURE

BACKGROUND OF THE INVENTION

The invention relates generally to pneumatically powered hand tools and more specifically to a reversible double-throw air motor for use with such tools.

Various pneumatic impulse tools, such as impact wrenches, are powered by reversible rotary vane pneumatic motors. Such motors are required to have a large stall torque in both forward and reverse directions. It is advantageous for such motors to be relatively small in size, since they are generally hand-held by an operator.

Most previously known reversible air motors are changed from forward to reverse operation by rerouting the inlet (pressure) and outlet (exhaust) paths at a location remote from the motor package, such as by shuttle spool valves or rotary valves. Such reversing arrangements take up valuable space, making the tool larger, complicate the construction in terms of adding parts and requiring additional labor for assembly, thus increasing the manufacturing cost, and creating tortuous air flow paths, thus reducing efficiency.

U.S. Pat. No. 4,822,264 to Kettner discloses a rotary vane air motor/reversal package having five main parts—a housing; a cylinder member; a rotor assembly; a distributor; and a valve plate, each of relatively complicated design and calling for precision manufacture to minimize leaks. In the Kettner device, the supply and exhaust passages leading to and from the cylinder chambers are reversed by changing the rotational position of a rotary valve plate that is positioned between a fixed distributor mounted within the motor casing on a rear side of the valve plate and a fixed cylinder casing on the front side of the valve plate. Although the design of Kettner's motor improves on some prior art reversible rotary vane motors in terms of size, it has some shortcomings. The distributor has two pressure ports located diametrically opposite each other, each of which is flanked on either side by an exhaust port. The exhaust ports are located very close to the pressure ports, thus presenting an opportunity for blowby of pressure air at the interface between the distributor and the valve plate. That possibility is exacerbated by the fact that the rotatable valve plate interfaces on opposite sides with fixed members with sliding fits. Thus, small tolerance variations can lead to large leaks and reduced efficiency. In addition, the location of the rotary valve plate, upstream from the motor's cylinder, requires that the actuator for the rotary valve plate (i.e., the part the user touches to switch between forward and reverse) is physically located rearward of the motor's cylinder. From an ergonomic perspective, this placement of the actuator is somewhat undesirable, as a location closer to the front end of the device would be more easily manipulated by the user under normal gripping circumstances. Further, the position of the valve plate is maintained by a spring/ball detent; avoiding the risk of an unintended rotation of the valve plate during handling of a tool equipped with the motor requires that the detent be quite strong which detracts from a desirable facility of reversal by the user. If the valve plate is rotated inadvertently from a desired position during handling, there is no assurance that it will be moved to the proper position during operation of the tool, and the motor performance may be compromised, resulting in a defective operation, such as a low torque on a fastener.

Thus, there remains a need for an improved design of a reversible double-throw air motor. Such a motor should allow for easy use and low production costs.

SUMMARY OF THE INVENTION

The reversible air motor of the present invention utilizes a moveable cylinder casing disposed within the motor's housing to switch between forward and reverse operation. The cylinder casing rotates between its forward and reverse positions in response to movement of an externally accessible actuator, the mechanical coupling via a front bearing plate rotationally coupled to the cylinder casing. In preferred embodiments, this actuator is biased to the proper position by reaction forces generated within the motor. In some embodiments, the coupling of the front bearing plate to the cylinder casing allows for the cylinder casing to float, thereby enabling the cylinder casing to self-center about the rotor. In other optional embodiments, the front bearing plate is pressed against the cylinder casing during operation by air pressure. Thus, in preferred embodiments, the present invention provides an easy to use motor that may be economically produced.

DETAILED DESCRIPTION OF THE INVENTION

Figure 1:
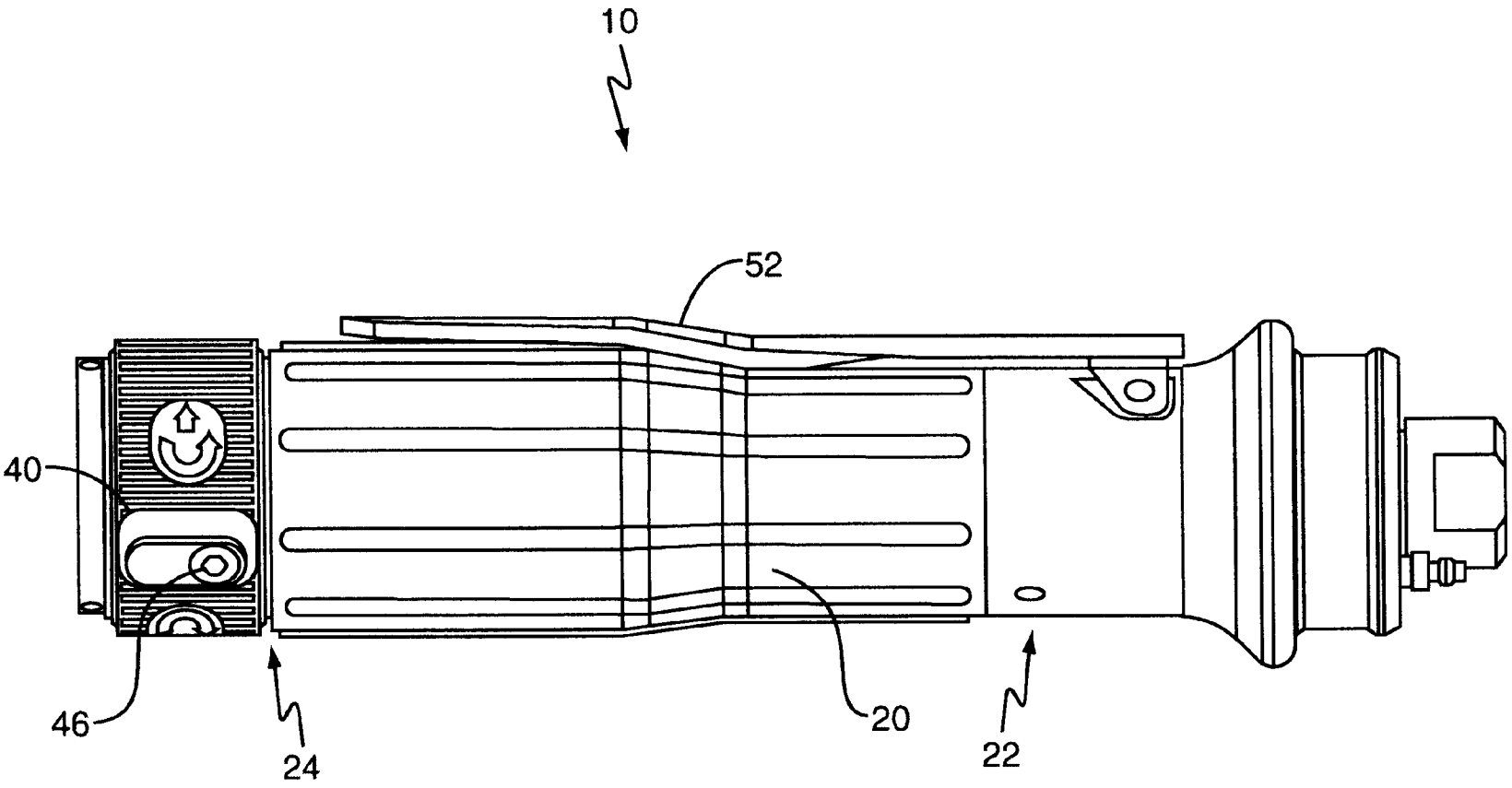
FIG. 1 is a side view of one embodiment of a motor according to the present invention.

One embodiment of the reversible double-throw air motor of the present invention is shown in FIG. 1. The motor includes a housing 20 having a cavity therein. Disposed internal to the housing are the valve plate 60, the cylinder casing 90, the rotor 120, and the front bearing plate 80. Disposed around the front portion of the housing 20 is the reversing ring 40 for switching the motor 10 between supply of rotational power in a first direction (forward mode) and supply of rotational power in an opposite second direction (reverse mode).

Figure 2:
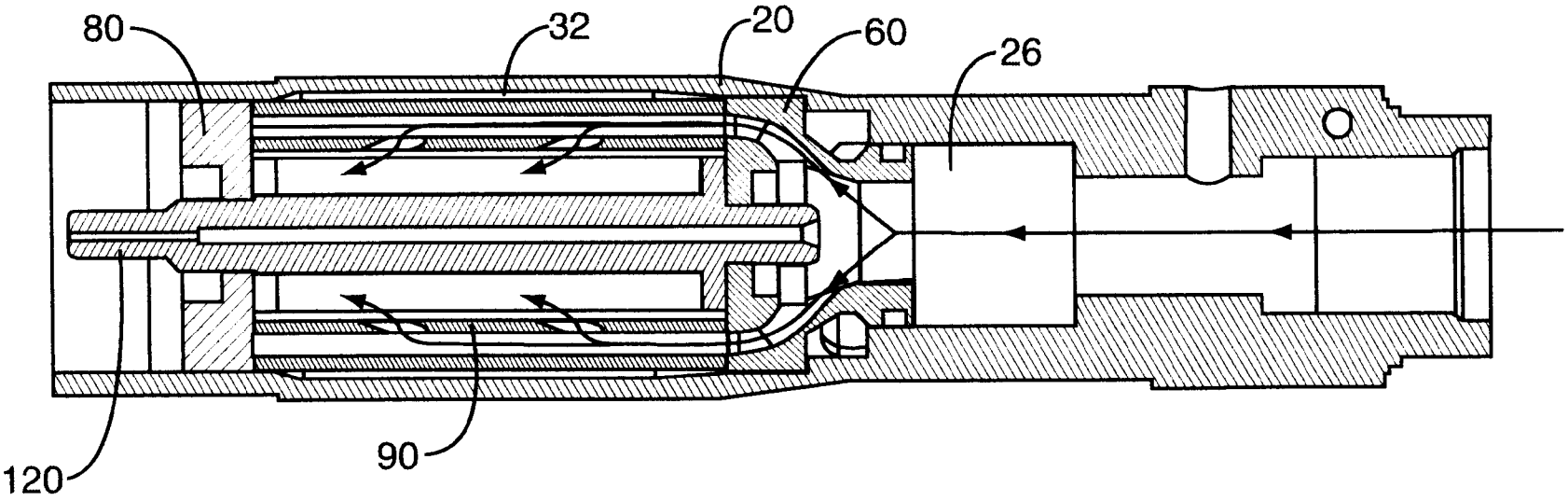
FIG. 2 is a cross-sectional view of the motor of FIG. 1 showing high pressure air flow.
Figure 3:
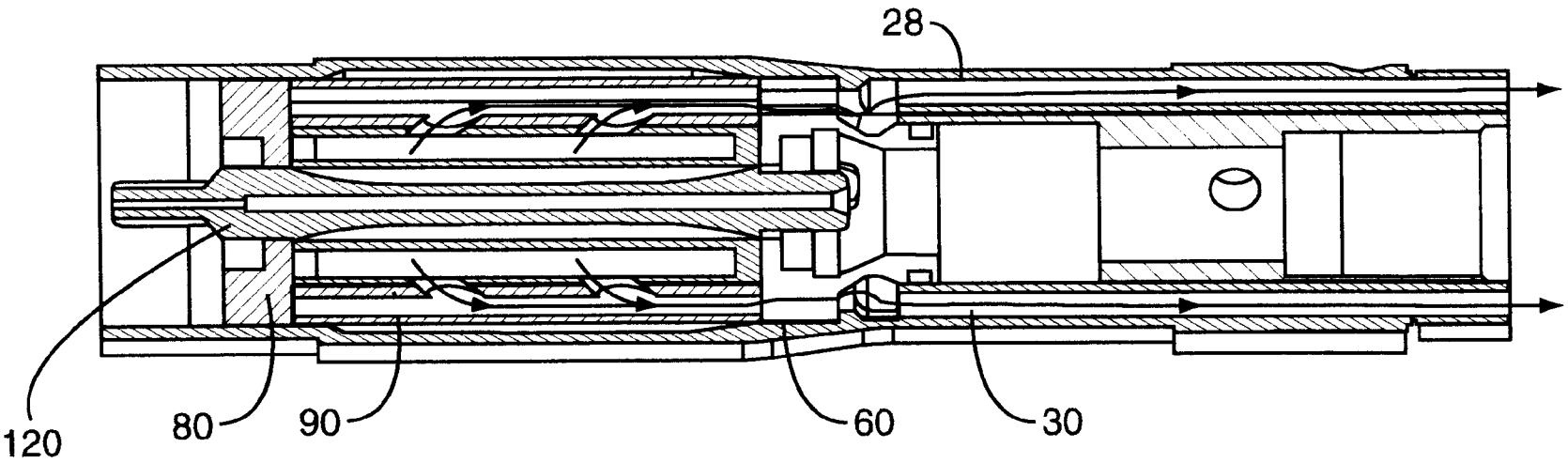
FIG. 3 is a cross-sectional view of the motor of FIG. 1, showing exhaust air flow.
Figure 4:
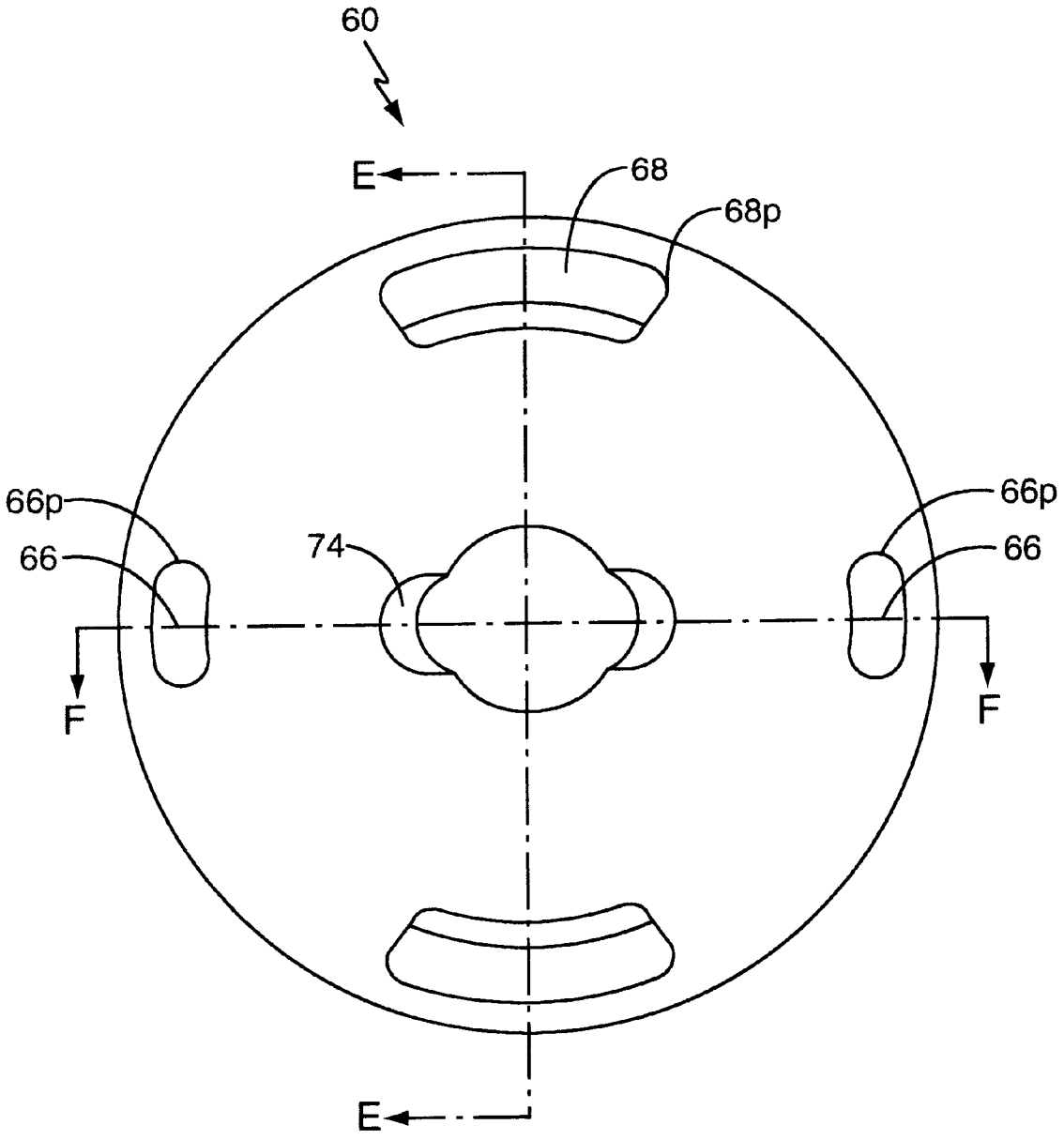
FIG. 4 is a view of the front of the valve plate.
Figure 5:
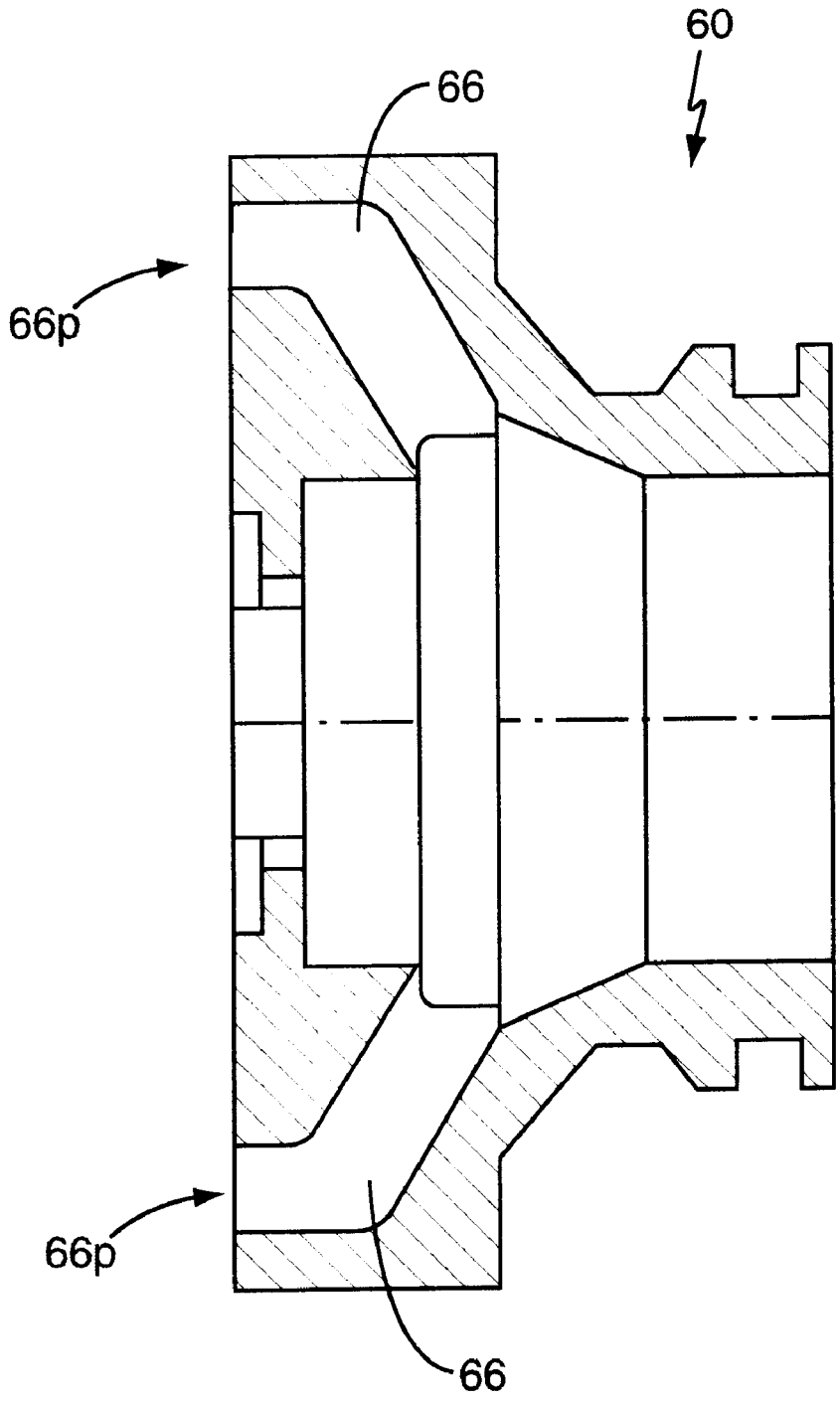
FIG. 5 is a side cross-sectional view, taken along the lines E—E of FIG. 4.
Figure 6:
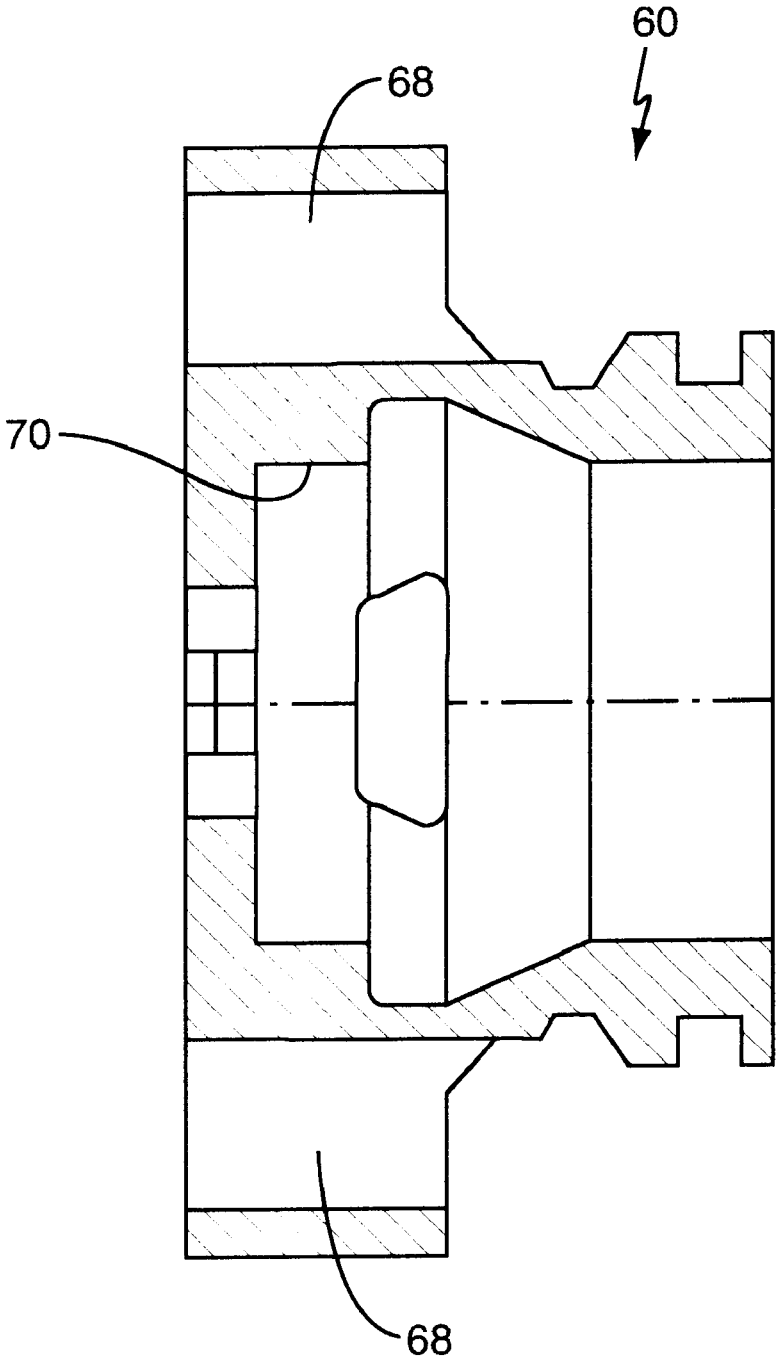
FIG. 6 is a side cross-sectional view, taken along the lines F—F of FIG. 4.
Figure 7:
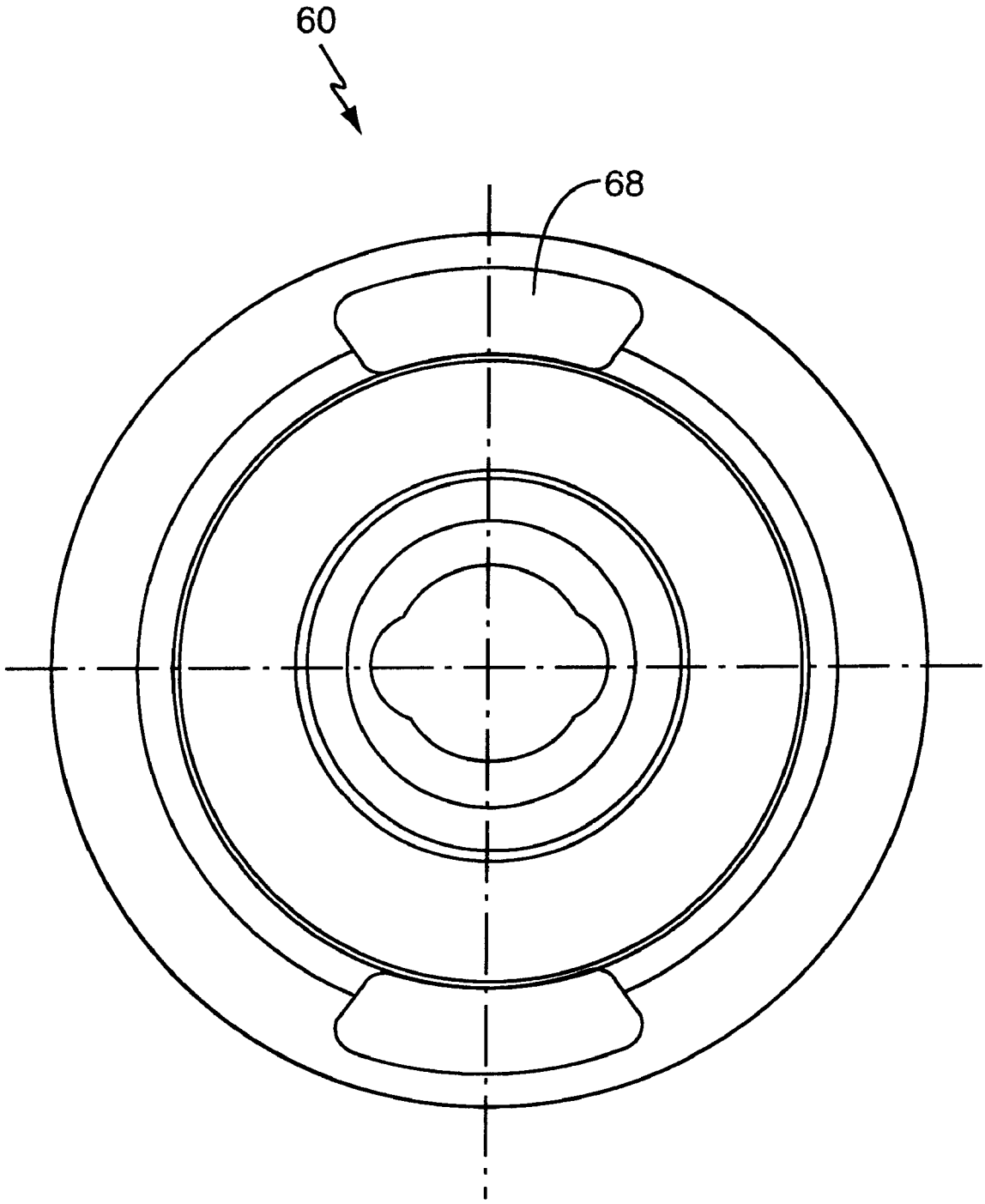
FIG. 7 is a view of the rear of the valve plate.
Figure 9:
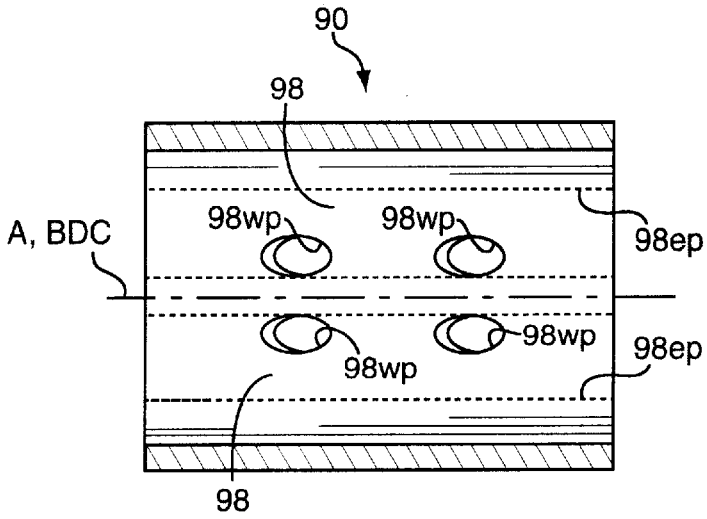
FIG. 9 is a side cross-sectional view, taken along the lines H—H of FIG. 8.
Figure 10:
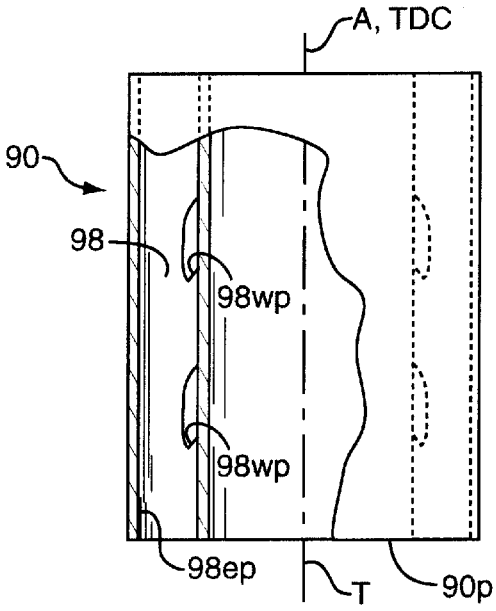
FIG. 10 is a partially cut-away side view of the cylinder casing.
Figure 11:
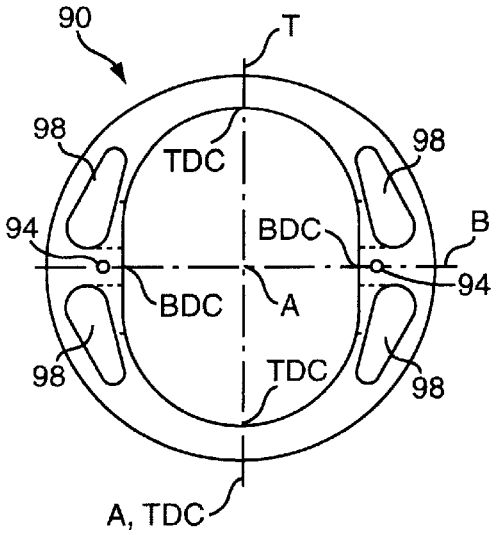
FIG. 11 is a view of the front of the cylinder casing.

Referring to FIGS. 1–3, the housing 20 has a rear portion 22 and a front portion 24 and includes a threaded socket (not shown) for accepting a coupling through which the motor is supplied with pressurized air. The pressurized air is fed to the valve plate 60 via supply passage 26 in housing 20, and the pressurized air supply is controlled by the trigger lever 52 in a conventional fashion. Two exhaust passages 28,30 extend along the sides of the rear portion 22 of the housing 20 to the valve plate 60, which serves as the end wall of a cavity 32 in the front portion 24 of the housing 20. A front bearing plate 80 provides the front end wall of the cavity 32.

Figure 8:
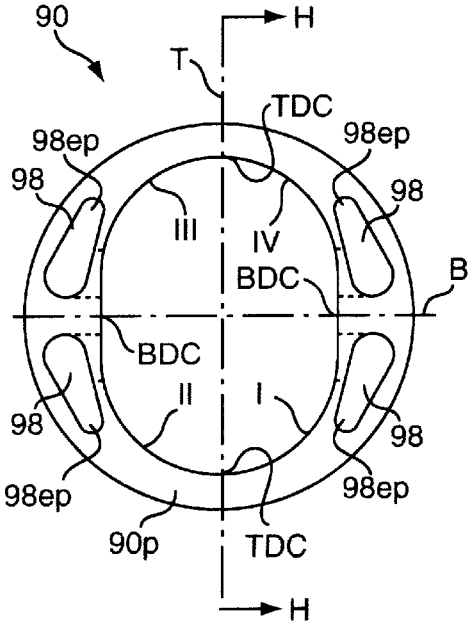
FIG. 8 is a view of the rear of the cylinder casing.

A tubular cylinder casing 90 (FIGS. 8–11) is received in the cavity 32 for rotation between a forward position and a reverse position, as described in more detail below. The inner surface 96 of the cylinder casing 90 defines a central bore of the cylinder casing 90 where the rotational power for the motor 10 is generated. The inner surface 96 preferably has a uniform, oblong cross section along its axial extent and includes two oppositely located bottom dead center positions (BDC) and top dead center positions (TDC), which correspond to the lines of intersection with the inner surface 96 of two mutually perpendicular planes of symmetry B and D of the inner surface 96 that include the cylinder axis A. The quadrants of the inner surface 96 of the cylinder casing 90 between the lines of intersection are labeled I, II, III, and IV in FIGS. 8, 12B and 13B.

Two pairs of transfer passages 98 are formed in the wall of the cylinder casing 90 opposite each other in symmetrical relation to the plane T of the top dead center lines TDC. Passages 98 of each pair are symmetrical with respect to the plane B of bottom dead center lines BDC. Each passage 98 opens at a kidney-shaped end port 98*ep* in the back end surface 90*p* of the cylinder casing 90 and opens at a wall port 98*wp* at the inner surface 96 of the cylinder casing 90. The wall ports 98*wp* may be formed by a round hole bored obliquely to the plane of the TDC lines and parallel to the planes of the BDC lines. The wall ports 98*wp* are closely spaced apart from each other and equidistant from the BDC lines. End ports 98*ep* at the end surface 90 of cylinder casing 90 are kidney-shaped so that the wall thickness of the cylinder casing 90*p* can be kept small and machining is easier to set up for. The passages 98 may optionally have a continuous cross-section corresponding to the kidney-shape of the end ports 98*ep* such that the cylinder casing 90 may be formed by extrusion. The back end surface 90*p* of the cylinder casing 90 abuts the valve plate 60, while the opposite end of the cylinder casing 90 abuts the front bearing plate 80.

Figure 14:
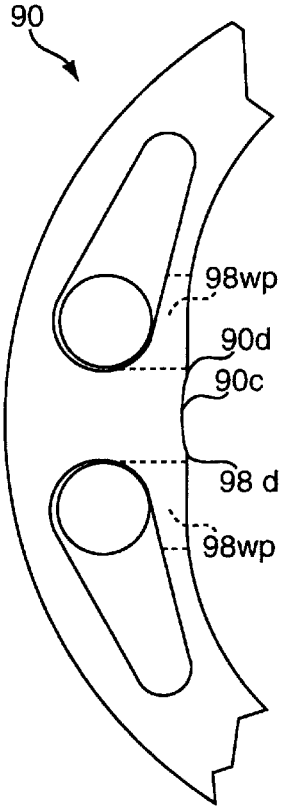
FIG. 14 is a partial end view of a portion of a cylinder casing of a modified configuration.

The shape of the oblong bore in the cylinder casing 90 can vary in geometry. Also, as shown in FIG. 14, the bore of a cylinder casing 90 may have concavities 90*c*, the curvatures of which are equal to the curvature of the rotor body 120*b*. Each concavity 90*c* is flanked by a cusp 90*d*. The concavities 90*c* may improve efficiency by reducing blowby at the BDC points where the rotor 120 is in running clearance with the cylinder wall. The concavities 90*c* lengthen the circumferential distance for running of the rotor 120 closely along the wall of the cylinder casing 90 from essentially a line (see FIGS. 12A and 13A) to several degrees of rotation of the rotor 120.

The valve plate 60 (FIGS. 4–7) is received in the housing 20 and secured with a pin or equivalent (not shown) to keep the valve plate 60 from rotating and an O-ring (not shown) at its perimeter to hold pressure supply passage 26. A pair of oblong pressure passages 66 open at their proximal ends to supply passage 26 (as extended by a central bore in valve plate 60) and thus are in fluid communication with the pressurized air supplied to the supply passage 26 when the trigger lever 52 is pressed. The front ends of pressure passages 66 form pressure ports 66*p*. A pair of exhaust passages 68 open at their proximal ends to exhaust passages 28,30 and at their front ends at exhaust ports 68*p*. An axial stepped bore 70 at the center of the valve plate 60 receives a bearing (not shown) by which the proximal end of a rotor 120 is rotatably mounted in the housing. The distal portion of the bore 70 has diametrically opposite notches 74, the distal ends of which are circumferentially elongated. The purpose of notches 74 is described below.

The rotor 120 is carried by a bearing in the valve plate 60 and a bearing in the front bearing plate 80 for rotation about the axis A of the cylinder casing 90. A circular cylindrical body portion 120*b* of the rotor is received within the cylinder casing 90 with its peripheral surface in close running clearance with the inner surface 96 of the cylinder casing 90 and its end surfaces in close running clearance with the surface of the valve plate 60 and the front bearing plate 80 that define the cavity 32. The inner surface 96 of the cylinder casing 90, the surfaces of the end plate 60, the front bearing plate 80 facing the bore in the cylinder casing 90, and the peripheral surface of the rotor body 120*b* define two crescent-shaped chambers.

The body portion 120*b* of the rotor 120 shown in the drawings has six circumferentially spaced-apart radial slots 124, each of which extends the full length of the body portion 120*b* and receives a vane 126 for radial sliding displacement (only one vane is shown in the drawings). Segments of the inner surface 96 of the cylinder casing 90 and the rotor body 120*b*, the front surface of valve plate 60, and the proximal surface of front bearing plate 80 between each adjacent pair of vanes 126 define subchambers of the two crescent-shaped chambers. The number of vanes may be varied from four to nine or more, odd numbers being preferred for eliminating what in any case is a small chance of the motor not starting if the rotor 120 should stop with two vanes 126 at bottom dead center. If that were to happen in a motor 10 with an even number of vanes 126, the user can rotate cylinder casing 90 slightly to reposition the BDC lines relative to the vanes 126 momentarily when starting the motor 10.

The inner edges of the vanes 126 are in radial clearance from the bases of the slots 124 at BDC. Kick-out slots or notches 74 in the valve plate 60 allow pressurized air to flow from the supply passage 26 into the clearance space and bias the vanes 126 outwardly into engagement with the inner surface 96 of the cylinder walls. The kick-out slots 74 are positioned circumferentially to be opposite the initial part of each working stroke of each subchamber of the motor to apply kick-out pressure just after each vane 126 passes BDC.

Figure 12A:
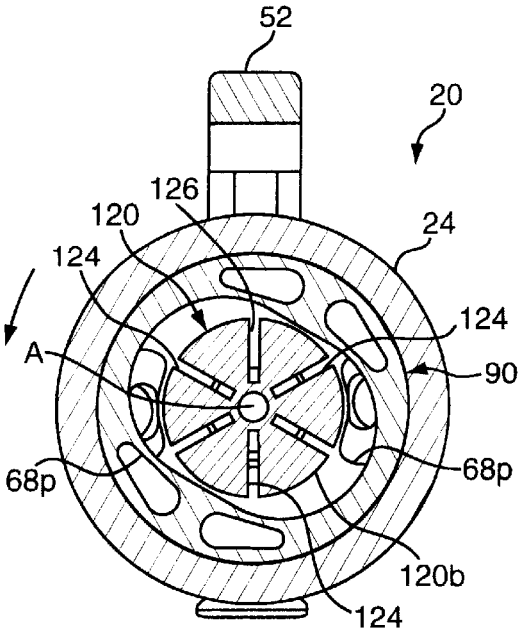
FIGS. 12A and 13A are end cross-sectional views taken through the cylinder casing show the motor in the forward and reverse positions, respectively.
Figure 12B:
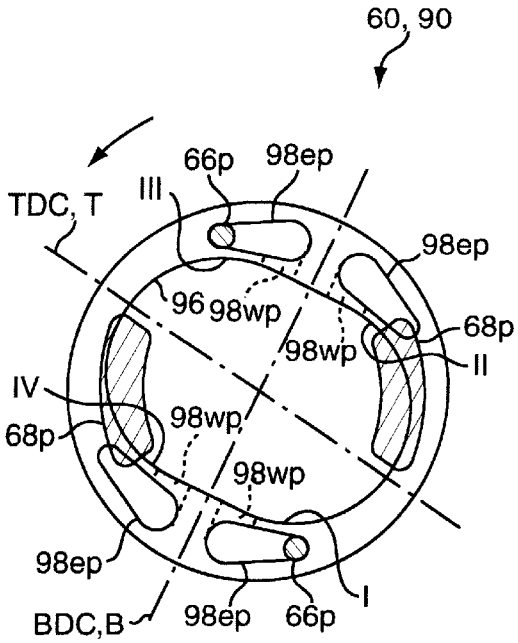
FIGS. 12B and 13B are schematic diagrams of the parts in the forward and reverse positions, respectively.
Figure 13A:
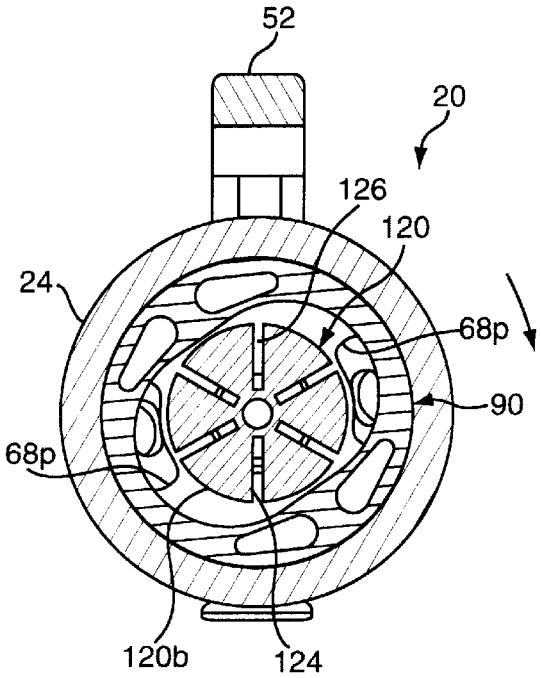
Figure 13B:
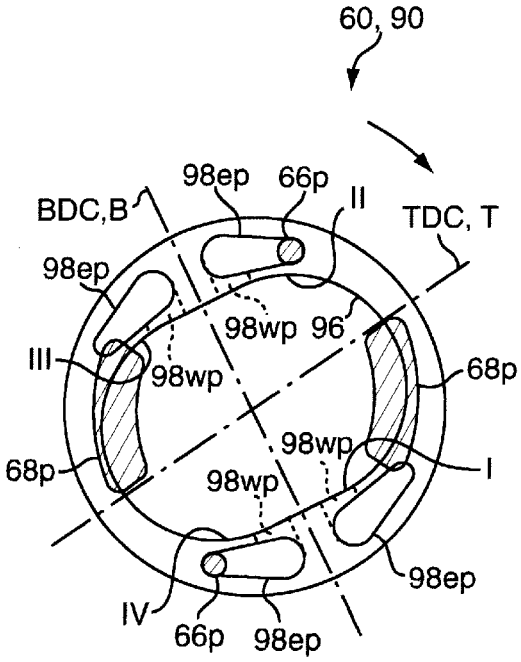

To operate the motor in forward mode, the user moves reversing ring 40 to cause the cylinder casing 90 to rotate to the forward position as shown in FIGS. 12A–12B, as is described further below. The following states and flow paths are set up with the cylinder casing 90 in that position:

Quadrant I—Pressure—cylinder end port 98*ep* (kidney-shaped) open to valve plate pressure port 66*p*—quadrant I is pressured from end port 98*ep* through the transfer passage to cylinder wall port 98*wp;*

Quadrant II—Exhaust—cylinder end port 98*ep* (kidney-shaped) open to valve plate exhaust port 68*p*—quadrant 11 exhausts from wall port 98*wp* through the transfer passage to 98*ep* and exhausts directly through the exhaust port 68*p* in the valve plate 60;

Quadrant III—Pressure—cylinder end port 98*ep* (kidney-shaped) open to valve plate pressure port 66*p*—quadrant III is pressured from end port 98*ep* through the transfer passage to cylinder wall port 98*wp*; and Quadrant IV—Exhaust—cylinder end port 98*ep* (kidney-shaped) open to valve plate exhaust port 68*p*—quadrant IV exhausts from the wall port 98*wp* through transfer passage to 98*ep* and exhausts directly through exhaust port 68*p*.

When the motor is activated by pressing trigger lever 52, any vane 126 that is counterclockwise (with respect to the view of FIG. 12) of the BDC line and in quadrant I or III is subjected to pressure, which produces a counterclockwise torque on the rotor 120. As each vane 126 passes in succession a BDC line and enters quadrant I or III, it becomes subject to pressure and produces torque. As each vane 126 passes a TDC line and enters quadrant II or IV, the subchamber upstream from it is opened to exhaust (see above). Accordingly, all of the subchambers are sequentially subject to pressure and exhaust, thus producing differential pressures across each vane twice in each evolution made by that vane 126.

When the user wants to operate the motor 10 in reverse rotation, the user moves reversing ring 40 to cause the cylinder casing 90 to rotate to the forward position as shown in FIG. 13, as is described further below. As seen in FIG. 13, the states and connections of the quadrants that prevail in the forward mode, as described above and shown in FIG. 12, are reversed such that quadrants II and IV are pressure quadrants and quadrants I and III are exhaust quadrants. Thus, the rotor 120 is driven clockwise with respect to the view of FIG. 13 (counterclockwise as viewed from the rear of the housing 20).

The general configuration and operation of the rotor 120, valve plate 60, and cylinder casing 90 are generally similar to that described in U.S. patent application No. 09/136,301, which is incorporated herein by reference. However, there are several differences between the motor of that application and the present invention, including but not limited to differences between the cylinder casing therein and the cylinder casing 90 of the present invention, that are described further below.

One problem of the Ser. No. 09/136,301 design is that the cylinder casing must be tightly constrained within the cavity of the housing, otherwise the rotor will be subject to undue wear. One reason for this is because the arm used to move the cylinder is only at one circumferential position. As the reaction force generated by the rotor and cylinder acts to push the arm against the housing, this in turn causes an unbalanced force to be applied to the cylinder. This unbalanced force tends to skew the cylinder with respect to the rotor. Thus, while the midpoint of the cylinder may be aligned with the rotor, the front and rear ends of the cylinder may not be aligned with the rotor during use. To counter this effect, the cylinder may be tightly constrained in the 09/136,301 housing, thereby minimizing the cylinder's movement. However, tightly fitting the cylinder within the housing leads to increased production costs to meet the tolerances required.

Figure 15:
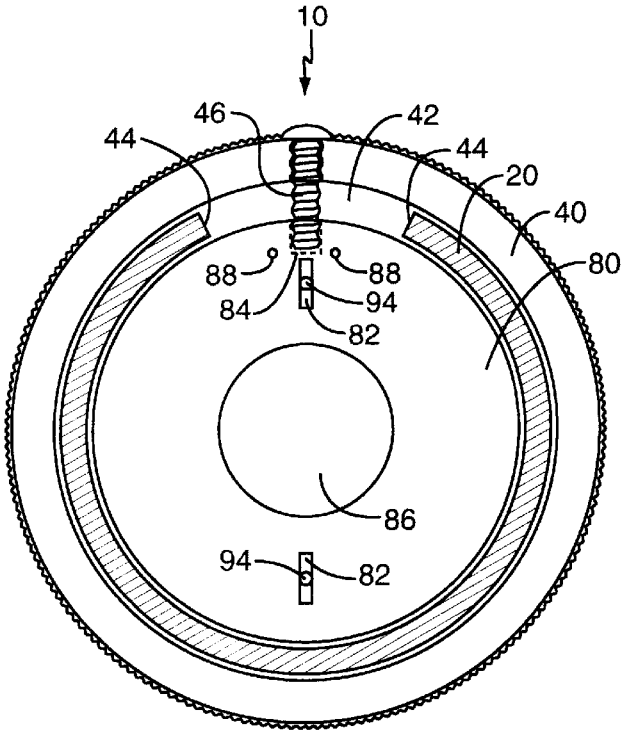
FIG. 15 is forward facing view of the front bearing plate area with the rotor removed.
Figure 16:
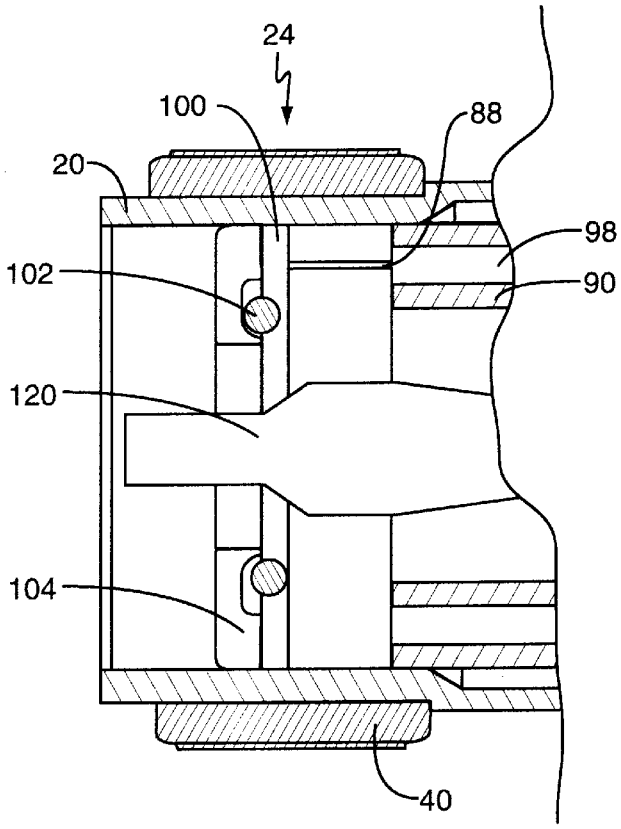
FIG. 16 is a side cut away view of the front portion of the housing showing the optional air pressure chamber in front of the front bearing plate.

The approach of one aspect of the present invention allows for a greater tolerance fit between the cylinder casing 90 and the housing 20 by providing a balanced resistance to the reaction force torque. While the front face of the cylinder casing 90 preferably abuts the front bearing plate 80, the cylinder casing 90 is also connected to the front bearing plate 80 by a pair of pins 94. These pins 94 preferably extend forwardly from the cylinder casing 90 and into opposing radial slots 82 on the rear face of the front bearing plate 80. See FIG. 15. The slots 82 should be disposed on opposite sides of the center hole 86 of the front bearing plate 80 through which the output of the rotor 120 is directed and should be just slightly larger in width than the pins 94 such that a sliding fit between the two is established. Further, the pins 94, and the corresponding radial slots 82, should be disposed 180° apart. In this way, the reaction force on the cylinder casing 90 acts against two points that are symmetrically disposed about the axis of the cylinder casing 90, rather than one. Thus, the skewing effect of a single point force application is avoided. Further, the cylinder casing 90 is allowed move with limited relative movement with respect to the front bearing plate 80, at least generally along the plane of the slots 82. This action may be referred to as floating. The floating allows the cylinder casing 90 to at least partially self-center about the rotor 120.

In another aspect of the present invention, alone or in combination with the "floating" rotationally moveable cylinder casing 90, the approach of the present invention utilizes a moveable front bearing plate 80 to help select between forward and reverse. The front bearing plate 80 is positioned within the housing 20 such that it is able to rotate with respect to the housing 20 from a first position to a second position. The rotation of the front bearing plate 80 is controlled by the movement of an actuator 40 that is accessible to the user. Preferably, this actuator 40 takes the form of a reversing ring 40 that is annularly disposed about the housing 20 and connected to the front bearing plate 80 by a tab 46. Further, the rotation of the front bearing plate 80 is limited by the action of a tab 46 against a slot 42 in the housing 20. In the embodiment shown in FIG. 15, the tab 46 takes the form of a screw 46 extending inwardly from the reversing ring 40. The screw 46 extends into a registration hole 84 in the front bearing plate 80, which may or may not be threaded. To reach the front bearing plate 80, the screw 46 extends through a slot 42 in the housing. For reference, the housing slot 42 is bounded by first and second slot ends 44. Thus, the rotation of the front bearing plate 80 is limited by the relative locations of the first and second ends 44 of the housing slot 42. Preferably, the arc swept by the slot 42 should be such that the tab 46 rests firmly against one end 44 of the slot 42 when the front bearing plate 80 is fully in the forward position and against the opposite end 44 of the slot 42 when the front bearing plate 80 is fully in the reverse position. Preferably, the location of the slot ends 44 allows for more than 45° of rotation, and more particularly between about 50°–55°. As described above, the cylinder casing 90 is joined to the front bearing plate 80 via pins 94 disposed in slots 82 in the front bearing plate 80. However, it should be noted that two pins 94 are not required for this invention aspect to function; instead, the it is only required that the front bearing plate 80 and the cylinder casing 90 be rotationally coupled. Thus, the joining of the cylinder casing 90 to the front bearing plate 80 may be by any method known in the art, such as by the use of interconnecting pins 94, gluing, screwing, etc. With this configuration, rotation of the front bearing plate 80 to the first position causes the cylinder casing 90 to assume the forward position; conversely, rotation of the front bearing plate 80 to the second position causes the cylinder casing 90 to assume the reverse position. This arrangement has at least two advantages. First, by relating the reversing ring 40 to the front bearing plate 80, the reversing ring 40 may be placed farther forward on the housing 20 than with prior designs. As such, the present design allows for the actuator controlling the direction of rotation—in the illustrative example, the reversing ring 40—to be more conveniently placed for the user. Second, the reaction force acting on the cylinder casing 90, via the linkage of the front bearing plate 80, causes the tab 46 to forced against the slot ends 44 when the motor 10 is in operation. The reaction torque on the rotor 120 in both forward and reverse modes is transmitted to tab 46, forcing it against the slot ends 44 in the housing 20. Should any frictional drag, vibration, or external handling force move the cylinder casing 90 from the desired or proper position, the reaction pressure forces on the cylinder casing 90 will immediately rotate the cylinder casing 90 until the tab 46 engages the end 44 of the housing slot 42. Thus, when the motor 10 is operating, the chance of it changing from one mode to the other is small because of the reaction torque; and, when the motor 10 is not operating, any dislocation of the cylinder casing 90 will be immediately corrected by the reaction torque when the motor 10 is started. The tab 46 and housing slot 42 thus provide a simple and effective way to permit changing the direction of operation and maintaining the direction of operation of the motor 10, once it is selected.

In another aspect of the present invention, air pressure may be used to help keep the front bearing plate 80 pressed against the cylinder casing 90. In some embodiments, the front bearing plate 80 is pressed against the cylinder casing 90 by a spring 102 trapped between the front bearing plate 80 and a more forwardly located bulkhead 104, such as the bulkhead 104 through which extends the output shaft associated with the rotor 120. The spring force in such an embodiment should be enough to counter-act the force acting to separate the cylinder casing 90 from the front bearing plate 80 resulting from the presence of pressurized air in the subchambers between the rotor 120 and the cylinder casing 90. Unfortunately, this spring force also tends to inhibit rotational movement of the front bearing plate 80, and thus the movement of the cylinder casing 90 between the forward and reverse positions. In some embodiments of the present invention, a lesser spring force is required because air pressure is also used to press the front bearing plate 80 and the cylinder casing 90 together. In such embodiments, a chamber 100 is disposed between the front bearing plate 80 and the aforementioned bulkhead 104. The chamber 100 may be annular in shape and disposed about, but excluding, the spring 102. The bulkhead end of the chamber 100 is sealed against air loss by any means known in the art, such as by appropriately placed plugs and O-rings (not shown). In addition, the front bearing plate 80 includes at least one, and preferably two, small orifices 88 that extend through the front bearing plate 80 from the front to the back thereof. The orifices 88 should be fairly small, such as 0.020" in diameter, and should be aligned with passages 98 of the ylinder casing 90. While not required in other embodiments, the passages 98 in the ylinder casing 90 in these embodiments should extend the length of the cylinder casing 90 so as to be in fluid communication with the orifice(s) 88. For these "air clamped" embodiments, when the motor 10 is not activated, the chamber 100 is typically not pressurized and only the action of the spring 102 pushes the front bearing plate 80 against the cylinder casing 90. Thus, when the motor 10 is not activated, the reversing ring 40, and therefore the cylinder casing 90, may be relatively easily moved. However, when the motor 10 is activated, high pressure air flows through one of the passages 98 aligned with the orifices 88, through the corresponding orifice 88, and into the chamber 100, thereby at least partially pressurizing the chamber 100. Exactly which passage 98 will have the high pressure air will depend on whether the cylinder casing 90 is in the forward position or the reverse position. The high pressure air in the chamber 100 will then act against the front side of the front bearing plate 80 to augment the spring 102 in pushing the rear face of front bearing plate 80 against the cylinder casing 90. If the second orifice 88 is present, the air in the chamber 100 will also somewhat escape through that orifice 88 to the corresponding passage 98 that is carrying exhaust air. On the other hand, the inclusion of the second orifice 88 allows the chamber 100 to be pressurized regardless of forward or reverse mode of the motor 10. Conversely, if there is no second orifice 88, then air losses may be lessened, but dynamic pressurization of the chamber 100 may be limited to only one mode of operation, such as the forward mode.

Further, the motor 10 can optionally be provided with some form of spring detent between tab 46 and the housing 20, primarily to provide a clicking sound that will tell the user that an operating (forward or reverse) position has been attained. Also, the motor 10 may be provided with a governor and/or adjustable torque shut-off mechanism of any suitable type known in the art. In addition, while the illustrative example of the motor 10 discussed above is configured in an "in-line" form, in which the housing 20 is generally cylindrical and is grasped in the hand of the user, the housing 20 may also be in other forms, such as a pistol shape, etc.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is aimed is:

1. A reversible double-throw air motor, comprising:

a) a housing;

b) a cylinder casing disposed in said housing and rotatable between a forward position corresponding to a forward rotational direction of said motor and a reverse position corresponding to a reverse rotational direction of said motor;

c) a front bearing plate disposed forward of, but in contact with, said cylinder casing and rotatably moveable between a plurality of positions; said cylinder casing and said front bearing plate at least partially defining a plurality of air drive chambers for generating rotational power;

d) said cylinder casing rotating between said forward position and said reverse position based on the position of said front bearing plate.

2. The motor of claim 1 further including means for rotatably coupling said cylinder casing to said front bearing plate.

3. The motor of claim 1 further including an actuator accessible to a user and operable to cause said front bearing plate to move between said first position and said second position.

4. The motor of claim 2 wherein said actuator is disposed at least as far forward as said front bearing plate.

5. The motor of claim 3 wherein said actuator comprises a generally annular ring.

6. A reversible double-throw air motor, comprising:

a) a housing having a cavity therein;

b) a rear bearing plate disposed in said cavity and having air passages therein;

c) a front bearing plate moveably disposed in said cavity;

d) an actuator accessible to a user and operable to cause said front bearing plate to move between a first position and a second position;

e) a generally tubular cylinder casing disposed in said cavity and having a lengthwise axis and in contact with said front bearing plate and said rear bearing plate, said cylinder casing joined to said front bearing plate, said cylinder casing rotatable with respect to said housing between a forward position and a reverse position;

f) a rotor disposed substantially within said cylinder casing and rotatable generally about said axis; and g) wherein moving said front bearing plate to said first position causes said cylinder casing to rotate to said forward position and wherein moving said front bearing plate to said second position causes said cylinder casing to rotate to said reverse position.

7. The air motor of claim 6 wherein said a housing includes a front portion and a rear portion and wherein said actuator is disposed proximate said front portion.

8. The air motor of claim 6 wherein said front bearing plate includes at least a pair of radial slots on the rear face thereof and further including at least a pair of pins associated with said cylinder casing, and wherein said cylinder casing joins to said front bearing plate via said pins extending into said radial slots.

9. The air motor of claim 6 wherein said housing includes an external opening and further including a tab extending through said opening, and wherein said actuator mechanically communicates with said front bearing plate via said tab.

10. The air motor of claim 9 wherein, in operation, reaction forces acting on said cylinder casing act to force said tab against the circumferential boundary of said opening.

11. The air motor of claim 10 wherein opposing circumferential boundaries of said opening are between about 50° and about 55° apart.

12. The air motor of claim 6 wherein, in operation, said cylinder casing is free to self-center about said rotor in at least one plane.

13. The air motor of claim 6 further including a chamber disposed forward of said front bearing plate and at least partially defined by said front bearing plate, wherein said chamber is pressurized during operation of said motor when said cylinder casing is in at least one of said forward position or said reverse position.

14. The air motor of claim 13 wherein said chamber is pressurized during operation of said motor when said cylinder casing is in said forward position.

15. The air motor of claim 14 wherein said chamber is further pressurized during operation of said motor when said cylinder casing is in said reverse position.

16. The air motor of claim 13 wherein said front bearing plate includes at least one orifice fluidly coupling said chamber to at least one of said air passages of said rear bearing plate.

17. A reversible double-throw air motor, comprising:

a) a housing having a cavity therein;

b) a cylinder casing disposed in said cavity and having a lengthwise axis and a midpoint;

c) a rotor disposed substantially within said cylinder casing and rotatable about said axis; and d) an actuator accessible to a user outside said housing and disposed forward of said midpoint of said cylinder casing, said actuator moveable between a first position corresponding to forward rotation of said rotor and a second position corresponding to reverse rotation of said rotor.

18. A method of controlling the rotational direction of a reversible double-throw air motor, comprising rotating a cylinder casing between a forward position corresponding to a forward rotational direction and a reverse position corresponding to a reverse rotational direction based on the position of a front bearing plate disposed forward of, but in contact with, said cylinder casing.

19. The method of claim 18 further comprising controlling the position of said front bearing plate by moving an externally accessible actuator disposed substantially forward of said cylinder casing between a first position and a second position.

20. The method of claim 19 wherein said actuator includes an annular ring attached to said front bearing plate.

21. The method of claim 19 wherein said actuator is disposed entirely forward of said cylinder casing.

* * * * *